United States Patent [19]

Broaddus

[11] Patent Number: 4,730,371

[45] Date of Patent: Mar. 15, 1988

[54] COATED CRIMPER ROLLS

[75] Inventor: Clarke R. Broaddus, Greenville, N.C.

[73] Assignee: E. I. Du Pont de Nemours and Company, Wilmington, Del.

[21] Appl. No.: 15,617

[22] Filed: Feb. 17, 1987

[51] Int. Cl.[4] ..... D02G 1/12

[52] U.S. Cl. ..... 28/269; 226/187

[58] Field of Search ..... 28/263, 268, 269, 270; 226/181, 187, 190, 193; 242/157 R

[56] References Cited

U.S. PATENT DOCUMENTS

| | | | |
|---|---|---|---|
| 3,080,134 | 3/1963 | England et al. | 242/157 R |
| 3,080,135 | 3/1963 | Steijn | 242/157 R |
| 3,237,270 | 3/1966 | Dennis . | |
| 3,787,229 | 1/1974 | Rudness | 242/157 R X |
| 3,848,300 | 11/1974 | Fuchs et al. | 28/269 |
| 4,006,517 | 2/1977 | Izawa et al. . | |

*Primary Examiner*—Robert R. Mackey

[57] ABSTRACT

A stuffer box crimper wherein the crimper roll surfaces comprise a hard wear resistant coating between opposite edge portions of the parent metal of the roll.

2 Claims, 2 Drawing Figures

COATED CRIMPER ROLLS

BACKGROUND OF THE INVENTION

This invention relates to stuffer box crimping apparatus and more particularly it relates to the surface structure of the crimper rolls used in the apparatus.

The crimper rolls of this invention can be advantageously used in stuffer box crimpers such as disclosed by Dennis in U.S. Pat. No. 3,237,270.

It is known to coat the peripheral surfaces of crimper rolls with a thin hard wear-resistant coating. However, when such roll surfaces are coated, the edge of the coating that interfaces with side of the roll is extremely difficult to coat to a true 90° edge and grinding is necessary after coating to establish such an edge. Often the grinding operation chips the thin coating causing roll failure. In addition, the crimper discs, at each side of the nip of the crimper rolls used to control the path of the tow into the stuffer box, during operation will wear the sides of the rolls but not the hard coating, leaving a wire edge which eventually will chip to cause roll failure.

SUMMARY OF THE INVENTION

A solution to the above-described problem involves undercutting a central portion at the periphery of each roll thus leaving a lip of parent metal around the circumference at opposite edges; applying a hard wear resistant coating to the undercut central portion and grinding the entire peripheral surface to a common diameter. In this manner, each edge is protected by parent metal thus preventing the coating from chipping during grinding of the side of the roll or as the side of the roll wears from the crimper discs during operation.

DETAILED DESCRIPTION OF THE PREFERRED EMBODIMENT

Figure 1:
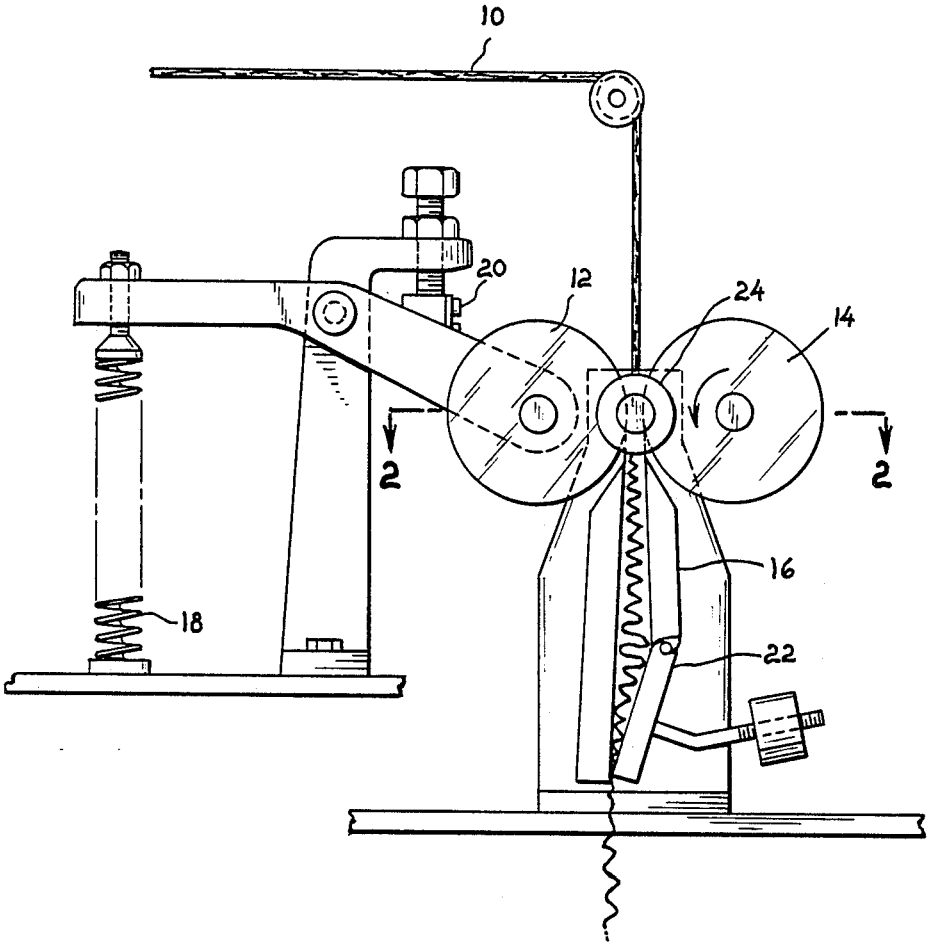
FIG. 1 is an elevation view of a stuffer box crimper partially in section.
Figure 2:
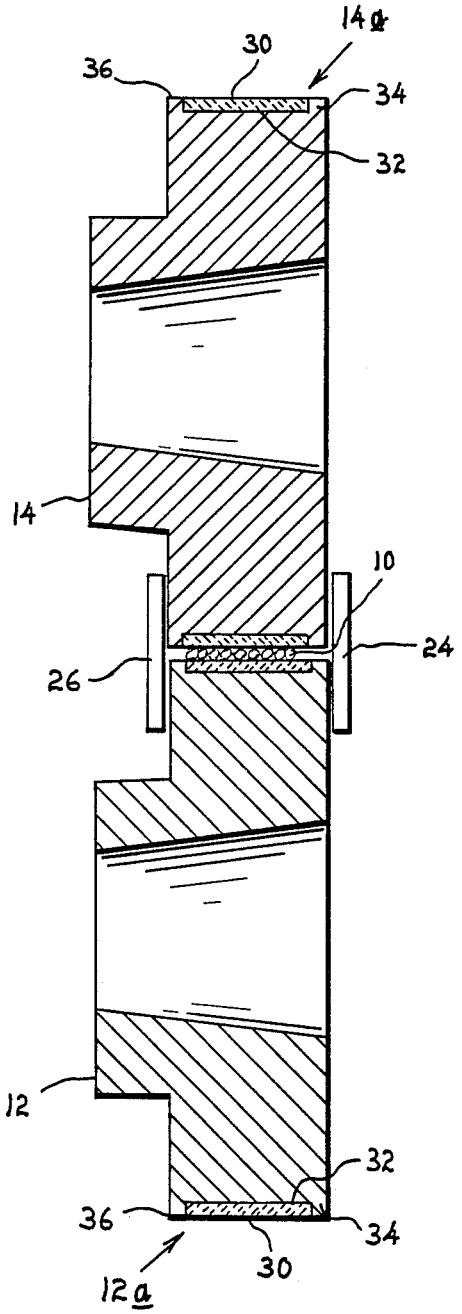
FIG. 2 is an enlarged sectional view taken along the line 2—2 of FIG. 1.

Referring to the drawings, in the embodiment chosen for purposes of illustration, a synthetic filamentary tow 10 is forwarded into contact with metal crimper rolls 12,14 and into stuffer box 16. Crimper roll 14 is driven by a means not shown and rotates as indicated by the direction arrow. Crimper roll 12 is an idler, urged into contact with the tow by means schematically illustrated by spring 18. The approach of crimper roll 12 toward crimper roll 14 may be limited by stop adjustable stop 20. Clapper 22 restricts egress of the crimped tow from the stuffer box which requires that the synthetic filamentary tow 10 be placed under high compression at the nip of the crimper rolls 12,14 in order to be forwarded into stuffer box 16. Lateral egress of the tow 10 between the nip and the entrance to the stuffer box is prevented by the presence of crimper discs 24,26. FIG. 2 shows more clearly the positioning of the crimper discs as well as the structure of the surface of crimper rolls 12,14. More particularly, the peripheral surfaces **12*a*, 14*a* of the rolls are seen to comprise a hard wearing material 30 coated to a central undercut portion 32 of the roll between opposite edge portions 34,36**. The crimper rolls are preferably made of steel while the coating is preferably tungsten carbide or chromium oxide.

The hard wear resistant coating 30 is preferably has a thickness in the range of from about 0.001 to about 0.020 inches. While tungsten carbide and chromium oxide are preferred coatings, almost any coating that is harder and more wear resistant that the parent metal of the roll would be suitable for use.

In the past, chromium oxide and like materials were not used as a coating for crimper rolls because of their propensity to chip and spall under high loads (stress) encountered in normal crimping operations. Protection of the coating material by parent metal edge portions greatly reduces the greatest areas of stress enabling the use of such materials as chromium oxide for coating crimper rolls.

I claim:

1. In a stuffer box crimping apparatus for crimping synthetic filamentary tow including a stuffer box having an entrance, a pair of driven cylindrical metal rolls having cooperating peripheral surfaces that extend from edge to edge of each roll in a common diameter which form a nip to forward the tow to the stuffer box and which are adjacent said entrance, means to restrict egress of the two from the stuffer box and means to prevent lateral egress of the tow between said nip and said entrance, the improvement comprising, the peripheral surface of each roll having an undercut portion located between opposite edge portions of the roll and a hard wear resistant coating filling said undercut portion to said peripheral surface from edge portion to edge portion whereby each edge of said roll is protected by metal to prevent said coating from chipping during grinding of the roll sides of wear from the means to prevent lateral egrees of the tow between said nip and said entrance.

2. The stuffer box crimper of claim 4, said metal being steel, said hard wearing coating being tungsten carbide.

* * * * *